US009042206B2

(12) United States Patent
Gabathuler et al.

(10) Patent No.: US 9,042,206 B2
(45) Date of Patent: May 26, 2015

(54) MECHANISM FOR DRIVING AN INDICATOR FOR A TIMEPIECE

(75) Inventors: Jacques Gabathuler, Chene-Bougerie (CH); Trung Thanh Nguyen, Bernex (CH); Serge Nicollin, Geneva (CH); Florent Zufferey, Le Grand-saconnex (CH)

(73) Assignee: BREITLING AG, Grenchen (CH)

( * ) Notice: Subject to any disclaimer, the term of this patent is extended or adjusted under 35 U.S.C. 154(b) by 0 days.

(21) Appl. No.: 14/131,525

(22) PCT Filed: Jun. 13, 2012

(86) PCT No.: PCT/IB2012/001227
§ 371 (c)(1), (2), (4) Date: Jan. 8, 2014

(87) PCT Pub. No.: WO2013/030636
PCT Pub. Date: Mar. 7, 2013

(65) Prior Publication Data

US 2014/0160897 A1 Jun. 12, 2014

(30) Foreign Application Priority Data

Aug. 30, 2011 (EP) ..... 11007040

(51) Int. Cl.
*G04B 19/20* (2006.01)
*G04B 19/253* (2006.01)
(Continued)

(52) U.S. Cl.
CPC ..... *G04B 19/25333* (2013.01); *G04B 19/02* (2013.01); *G04B 19/25373* (2013.01); *G04B 27/026* (2013.01)

(58) Field of Classification Search
CPC ..... G04B 19/25333; G04B 27/026; G04B 19/02; G04B 19/253
USPC ..... 368/37, 34
See application file for complete search history.

(56) References Cited

U.S. PATENT DOCUMENTS 54,198 A * 4/1866 Owen ..... 368/37
4,427,300 A 1/1984 Groothuis
(Continued)

FOREIGN PATENT DOCUMENTS

CH 54709 6/1912
CH 702137 5/2011
(Continued)

OTHER PUBLICATIONS

International Search Report dated Jan. 18, 2013, corresponding to PCT/IB2012/001227.
(Continued)

*Primary Examiner* — Sean Kayes
(74) *Attorney, Agent, or Firm* — Young & Thompson

(57) ABSTRACT

A mechanism for driving an indicator for a timepiece includes: a mobile for driving the indicator; a first lever mounted about a first pivot and including a beak to cooperate with a toothing of the mobile; a first cam arranged to rotate the first lever about the first pivot; a second lever mounted about a second pivot and to which the first pivot is rigidly connected; a second cam arranged to rotate the second lever about the second pivot; and elastic elements for maintaining the cooperation between the levers and cams; the levers and the cams being arranged so that the beak of the first lever cyclically describes a closed curve, each cycle including a first motion during which the beak leaves the toothing of the mobile without changing the angular position thereof and a second motion during which the beak re-enters the toothing to move the mobile.

15 Claims, 8 Drawing Sheets

(51) Int. Cl.
*G04B 19/02* (2006.01)
*G04B 27/02* (2006.01)

(56) References Cited

U.S. PATENT DOCUMENTS

| | | | | |
|---|---|---|---|---|
| 5,379,272 | A | 1/1995 | Parmigiani | |
| 7,038,974 | B2 | 5/2006 | Dalloz | |
| 7,158,448 | B1 | 1/2007 | Gabathuler et al. | |
| 8,570,841 | B2 * | 10/2013 | Goeller | 368/244 |
| 8,873,347 | B2 * | 10/2014 | Goeller | 368/261 |
| 2008/0279052 | A1 * | 11/2008 | Rochat et al. | 368/131 |
| 2012/0236691 | A1 * | 9/2012 | Hirano | 368/28 |
| 2012/0243381 | A1 * | 9/2012 | Goeller et al. | 368/34 |

FOREIGN PATENT DOCUMENTS

| | | | |
|---|---|---|---|
| DE | 198 52 347 | | 5/2000 |
| EP | 0052070 | A1 | 5/1982 |
| EP | 0 606 576 | | 7/1994 |
| EP | 1115041 | | 7/2001 |
| EP | 1524564 | A1 | 4/2005 |
| EP | 1746470 | A1 | 1/2007 |
| WO | 2007/020289 | | 2/2007 |

OTHER PUBLICATIONS

European Search Report, dated Mar. 21, 2012, from corresponding EP application.

* cited by examiner

MECHANISM FOR DRIVING AN INDICATOR FOR A TIMEPIECE

The present invention relates to a mechanism for driving an indicator for a timepiece. The indicator is, for example, a date indicator, a weekday indicator or a month indicator in a calendar display, and may be in the form of a hand or a disc.

More particularly, the present invention relates to a mechanism for driving an indicator in which a mobile for driving the indicator, such as a star rigidly connected to the indicator, is actuated by a beak of a lever controlled by a cam. Examples of such a mechanism are described in the patent CH 702137 (for an instantaneous counter) and in the patent EP 1115041 (for a fast date corrector).

In this type of mechanism, the lever controlled by the cam makes a to-and-fro rotational motion which causes its beak to enter and leave the toothing of the driving mobile. As the beak is disengaging from the toothing of the driving mobile the beak touches a tooth of this latter, thus requiring the beak to be made retractable to avoid a blocking, as in the patent CH 702137, or requiring accepting that the disengagement of the beak causes the driving mobile to momentarily move backward, as in the patent EP 1115041, which backward motion is then caught up by the positioning jumper of the driving mobile. In the first case, a risk exists that during the instantaneous jump of the driving mobile caused by the lever, the driving mobile continues its motion under the effect of its inertia while making the retractable beak unclick, thus causing a false display. In the second case, the momentary backward motion of the mobile is prejudicial to the aesthetics of the display.

There is also known from the patent CH 54709 a mechanism for actuating a toothed wheel, such as a chronograph counter wheel, comprising a first lever controlled by a snail cam. The first lever carries a click terminated by a beak for actuating the toothed wheel, as well as pins. The pins guide a first arm of a second lever to control this latter. As the first lever is being gradually raised by the cam, the beak of the click leaves the toothing of the toothed wheel without touching the said toothed wheel. At about the end of this raising a second, elastic arm of the second lever presses the click to rotate it about its pivot carried by the first lever and to cause the beak to re-enter the toothing of the toothed wheel. As the first lever is jumping from the higher part to the lower part of the cam, the beak moves the toothed wheel by one pitch. Thus, in this mechanism, the beak of the click cyclically describes a closed curve the shape of which allows the beak to leave the toothing of the toothed wheel without touching it. This mechanism therefore does not have the drawbacks mentioned above in connection with the documents CH 702137 and EP 1115041. On the other hand it has another drawback: as the toothed wheel is being actuated by the click, i.e. during the instantaneous jump, the click is no longer subject to the action of the elastic arm of the second lever and therefore is maintained in the toothing of the toothed wheel only by the angle of draw, which is determined by the shape of the beak and of the teeth of the toothed wheel. This causes a risk that the beak disengages from the toothing of the toothed wheel, particularly in the event of an impact.

The present invention aims at remedying the aforementioned drawbacks and provides to this effect a mechanism for driving an indicator for a timepiece, comprising:

a mobile for driving the indicator, a first lever mounted about a first pivot and comprising a beak intended to cooperate with a toothing of the mobile to move the mobile, a first cam arranged to rotate the first lever about the first pivot, a second lever mounted about a second pivot and to which the first pivot is rigidly connected, a second cam arranged to rotate the second lever about the second pivot, and elastic means for maintaining the cooperation between the levers and the cams, the levers and the cams being arranged so that the beak of the first lever cyclically describes a closed curve, each cycle comprising a first motion during which the beak leaves the toothing of the mobile without changing the angular position of said mobile and a second motion during which the beak re-enters the toothing of the mobile to move said mobile.

The use of the two cams and of the second lever thus enables the first lever to leave the toothing of the mobile without touching it and to re-enter said toothing while causing the mobile to advance. The beak therefore does not need to be retractable. It can be rigidly connected to the rest of the first lever, thus particularly preventing the mobile from continuing its motion under the effect of its inertia just after its being actuated by the first lever in the case where the motion of the mobile comprises instantaneous jumps. The elastic means may indeed maintain the beak in the toothing of the mobile with a sufficient force for blocking the mobile after its being actuated, unlike the elastic means of the retractable beaks of the prior art which must be sufficiently weak to allow the beak to retract as it is leaving the toothing of the mobile. Moreover, in the present invention the elastic means maintain the beak in the toothing of the mobile during actuation of this latter, thus avoiding the risks that the beak accidentally disengages from the toothing of the mobile.

Preferably, the first and second cams are coaxial.

The mechanism according to the invention may further comprise a third lever mounted about a third pivot and arranged so that the first lever is driven by the first cam via this third lever.

A device may be provided to cause the beak to automatically leave the toothing of the mobile before a correction of the position of said mobile.

This device can be actuated by a displacement of a winding stem into a predetermined axial position, for example.

This device may comprise means for moving the second lever away from the second cam, this motion causing a displacement of the first lever causing the beak to leave the toothing of the mobile.

The present invention also relates to a calendar mechanism comprising a mechanism as defined above.

The present invention also relates to a timepiece comprising a mechanism as defined above.

Other features and advantages of the present invention will become clear from reading the following detailed description given with reference to the attached drawings in which.

In the present invention "calendar" is understood to mean in particular the indication of the date and/or the day of the week and/or the month.

Figure 1:
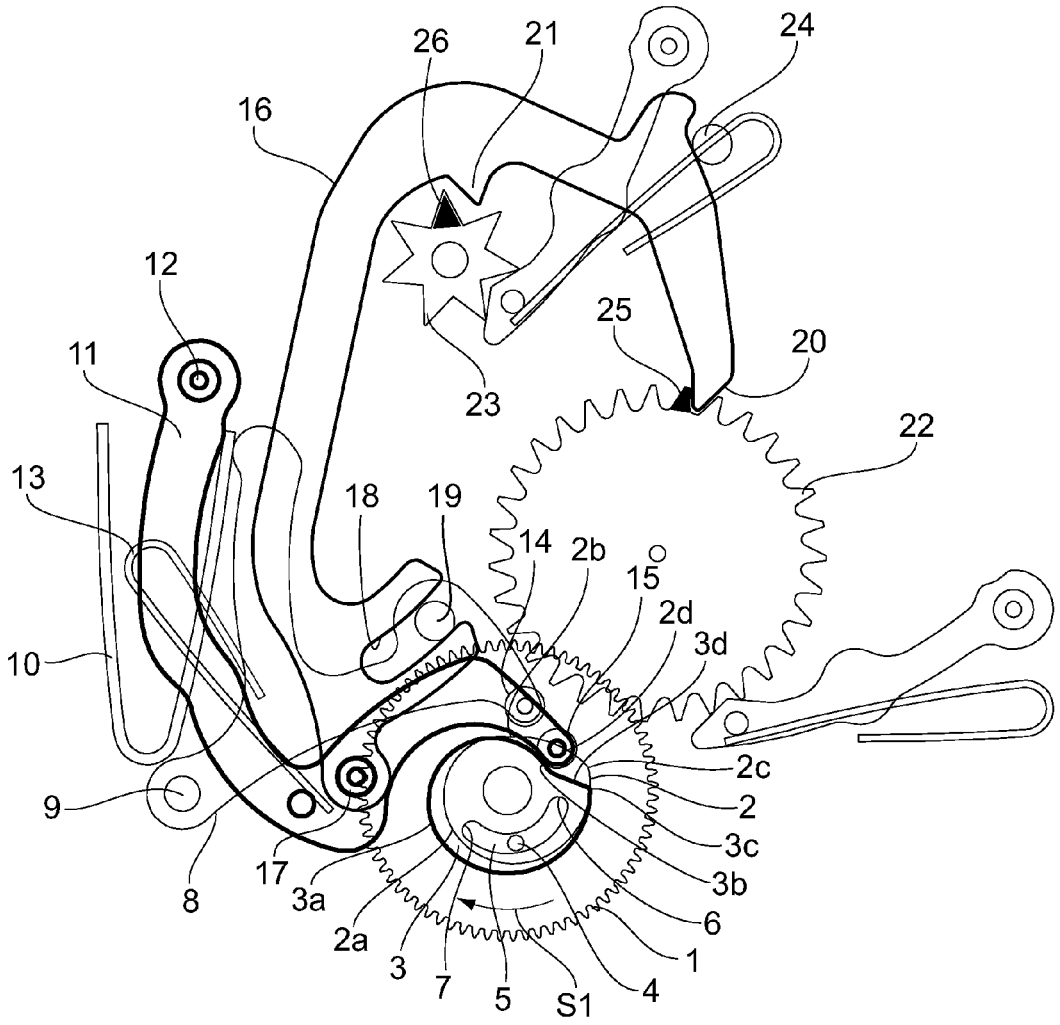
FIG. 1 shows a calendar mechanism according to a first embodiment of the invention; in this figure three levers are shown with different line thicknesses and two cams are shown with different line thicknesses to permit the reader to distinguish them better.
Figure 2A:
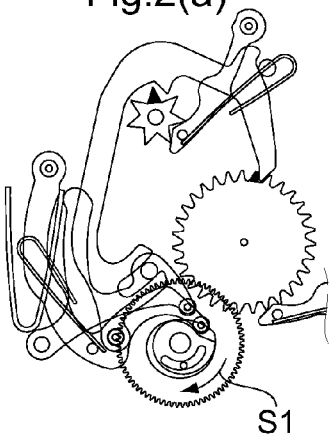
FIG. 2 shows a sequence of states of the calendar mechanism according to the first embodiment during a rotation of the time indicators of the timepiece by a number of revolutions corresponding to 24 hours of time display in the clockwise direction.
Figure 2B:
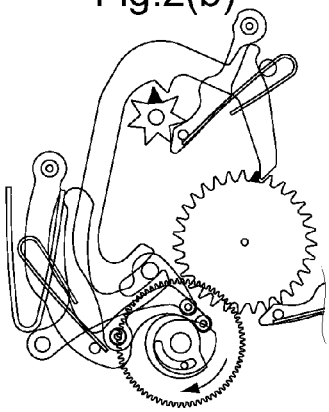
Figure 2C:
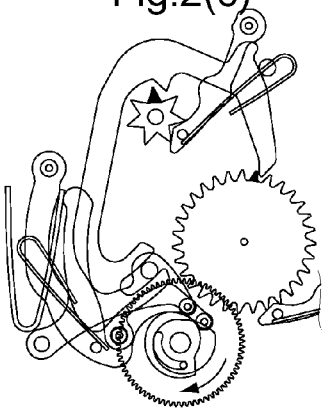
Figure 2D:
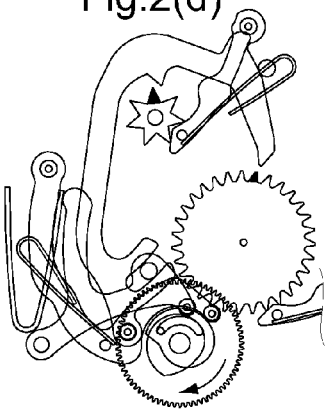
Figure 2E:
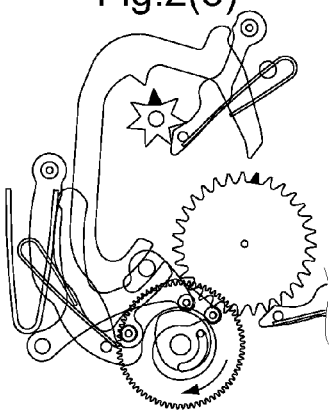
Figure 2F:
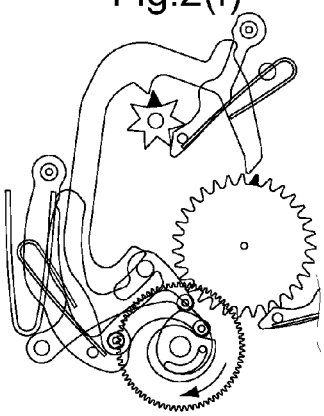
Figure 2G:
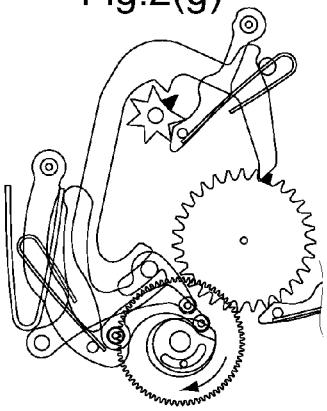
Figure 3A:
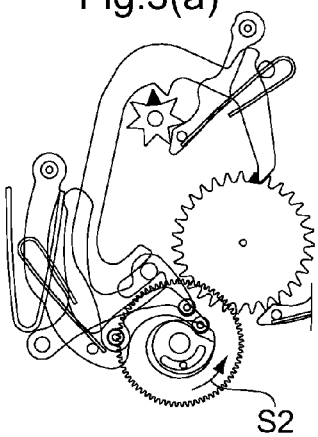
FIG. 3 shows a sequence of states of the calendar mechanism according to the first embodiment during rotation of the time indicators of the timepiece by a number of revolutions corresponding to 24 hours of time display in the anti-clockwise direction.
Figure 3B:
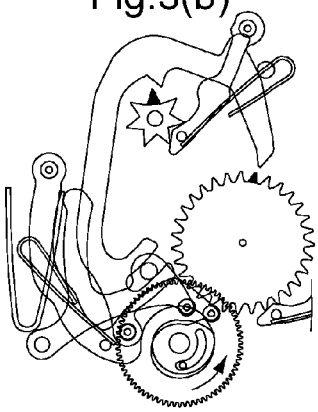
Figure 3C:
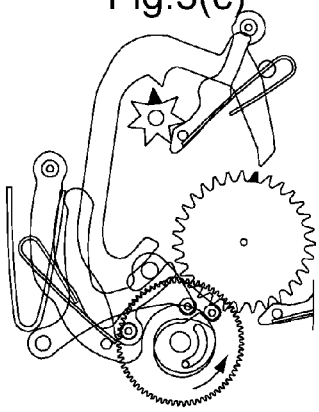
Figure 3D:
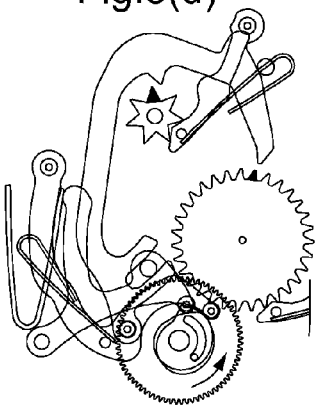
Figure 3E:
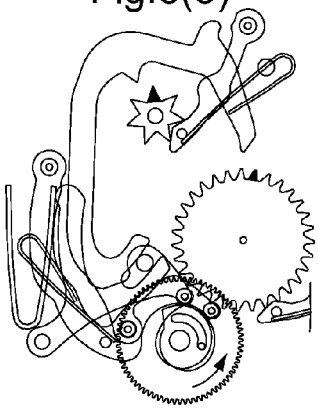
Figure 3F:
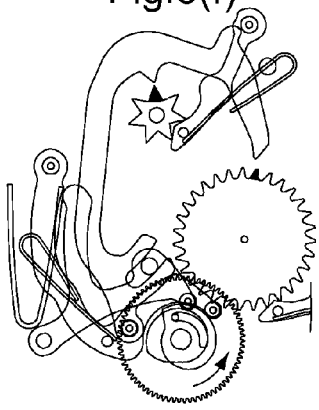
Figure 3G:
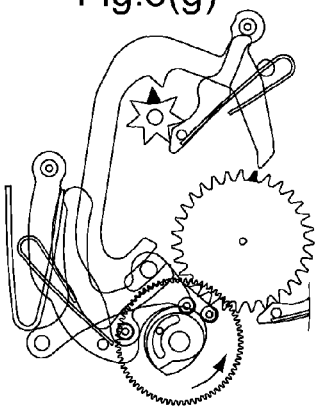
Figure 3H:
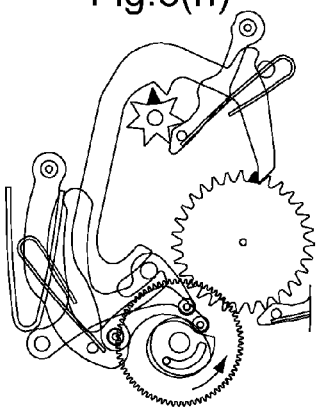

With reference to FIG. 1, a calendar mechanism according to a first embodiment of the invention for a timepiece such as a wrist watch has a calendar wheel 1 driven in a conventional manner by the going train of the timepiece during normal operation thereof. The calendar wheel 1 thus rotates at a rate of one revolution per 24 hours in the direction indicated by the arrow S1. During time setting of the timepiece, the calendar wheel 1 is driven by the time-setting gear train in one direction or the other.

Two cams, i.e. a calendar cam 2 and an isolating cam 3, are coaxial with the calendar wheel 1. An eccentric pin 4 driven into the calendar cam 2 is engaged in an opening 5 in the calendar wheel 1, said opening 5 being in the form of an arc of a circle and comprising a first end 6 and a second end 7. The pin 4 and the opening 5 define a range of rotation of the calendar cam 2 with respect to the calendar wheel 1. The isolating cam 3 is rigidly connected to the calendar wheel 1. Each of the cams 2, 3 has an arming part 2*a*, 3*a*, of increasing radius, between a lower part 2*b*, 3*b* and a peak 2*c*, 3*c* and a shorter, plunging part 2*d*, 3*d* between the peak 2*c*, 3*c* and the lower part 2*b*, 3*b*. In the illustrated example, the lower part 2*b* of the calendar cam 2 defines a hollow and its plunging part 2*d* is convex and has a positive slope. The plunging part 3*d* of the isolating cam 3 is substantially straight and has a positive slope.

A cam lever 8 mounted about a pivot 9 is applied for part of the time against the calendar cam 2 by a spring 10. An isolating lever 11 mounted about a pivot 12 is applied against the isolating cam 3 by a spring 13. The pivots 9, 12 are mounted on a fixed piece of the timepiece movement, such as the bottom plate or a bridge. The contact between the levers 8, 11 and the cams 2, 3 is preferably effected by means of rollers 14, 15 respectively mounted on the levers 8, 11 and which roll on the cams 2, 3. However, in a variation, beaks of the levers 8, 11 could cooperate directly with the cams 2, 3.

A calendar lever or "actuating lever" 16 is mounted about a pivot 17 carried by the isolating lever 11 and has a U-shaped oblong opening 18 which receives a pin 19 carried by the cam lever 8. Thus the calendar lever 16 is controlled both by the cam lever 8, thus by the calendar cam 2, and by the isolating lever 11, thus by the isolating cam 3. The calendar lever 16 has beaks 20, 21 which cooperate respectively with a date star 22 and a day star 23. Indicators such as hands or discs are rigidly connected to the stars 22, 23 respectively and indicate to the user the day of the month and the day of the week in cooperation with graduations or apertures in a dial of the timepiece.

FIGS. 2(*a*) to 2(*g*) show different successive configurations of the calendar mechanism according to this first embodiment of the invention during normal operation of the timepiece or during time setting in the forward direction, i.e. in the clockwise direction of the time indicators of the timepiece, wherein the calendar wheel 1 and, with it, the isolating cam 3 rotate in the direction S1. FIG. 2(*a*), like FIG. 1, illustrates the configuration of the calendar mechanism just after midnight: the calendar lever 16 is in abutment against an abutment pin 24, the beaks 20, 21 of the calendar lever 16 are in the toothing of the stars 22, 23 respectively, the cam lever 8 is out of contact with the calendar cam 2 because it is held against the action of the spring 10 by the calendar lever 16 which cooperates with the pin 19, the isolating lever 11 is applied against the lower part 3*b* of the isolating cam 3 and the pin 4 is away from the ends of the oblong opening 5, in particular from the first end 6. From this configuration, the cooperation between the arming part 3*a* of the isolating cam 3 and the isolating lever 11 causes the isolating lever 11 to be raised against the action of the spring 13, which raises the calendar lever 16 of which the pivot 17 is carried by the isolating lever 11 (FIG. 2(*b*)). The beaks 20, 21 of the calendar lever 16 thus begin to leave the toothings of the stars 22, 23 without touching any of these toothings and, therefore, without modifying the angular position of the said stars. The calendar cam 2 remains immobile until the first end 6 of the oblong opening 5 meets the pin 4, causing the calendar cam 2 to be fixed relative to the calendar wheel 1 and to the isolating cam 3 (FIG. 2(*c*)). The cam lever 8 then comes into contact with the arming part 2*a* of the calendar cam 2 and is raised thereby (FIGS. 2(*d*) and 2(*e*)), and the calendar lever 16, of which the beaks 20, 21 have now completely left the toothings of the stars 22, 23, continues to move away from the stars 22, 23. The calendar lever 16 which, since the beginning of the movement, was guided by the abutment pin 24 (FIGS. 2(*a*) to 2(*d*)), moves away therefrom (FIG. 2(*e*)). Near the end of a revolution of the date wheel 1, i.e. just before midnight, the isolating lever 11 passes from the peak 3*c* to the lower part 3*b* of the isolating cam 3 (FIG. 2(*f*)), which moves the calendar lever 16 towards the stars 22, 23. Then, at midnight, it is the cam lever 8 which passes the peak 2*c* of the calendar cam 2, causes it to rotate suddenly under the action of the spring 10 (which is made possible by the cooperation between the pin 4 and the oblong opening 5) and, in falling, drives the calendar lever 16, of which the beaks 20, 21 re-enter the toothings of the stars 22, 23, causing the stars 22, 23 to rotate by one pitch (FIG. 2(*g*)). Solely for the purpose of understanding the drawings, one tooth 25, 26 of each of the stars 22, 23 has been marked to show that the position of the stars 22, 23 has changed in FIG. 2(*g*) with respect to FIGS. 2(*a*) to 2(*f*). In FIG. 2(*g*), the cams 2, 3 and the levers 8, 11, 16 are in their position of FIG. 2(*a*) again.

FIGS. 3(*a*) to 3(*h*) show different successive configurations of the calendar mechanism according to this first embodiment of the invention during time setting in the backwards direction, i.e. in the anti-clockwise direction of the indicators of the time display, wherein the calendar wheel 1 and, with it, the isolating cam 3 rotate in a direction S2 opposite to the direction S1. FIG. 3(*a*), like FIG. 1, illustrates the configuration of the calendar mechanism just after midnight: the calendar lever 16 is in abutment against the abutment pin 24, the beaks 20, 21 of the calendar lever 16 are in the toothing of the stars 22, 23 respectively, the cam lever 8 is out of contact with the calendar cam 2 because it is held against the action of the spring 10 by the calendar lever 16 which cooperates with the pin 19, the isolating lever 11 is applied against the lower part 3*b* of the isolating cam 3 and the pin 4 is away from the ends of the oblong opening 5, in particular from the second end 7. The isolating lever 11 is raised from the lower part 3*b* to the peak 3*c* of the isolating cam 3 by the plunging part 3*d* (FIG. 3(*b*)), which causes the beaks 20, 21 of the calendar lever 16 to leave the toothings of the stars 22, 23 without touching any of these toothings and, therefore, without modifying the angular position of the stars 22, 23, then begins to descend along the part 3*a* of the isolating cam 3. The calendar cam 2 remains immobile until the second end 7 of the oblong opening 5 meets the pin 4, thus causing the calendar cam 2 to be fixed relative to the calendar wheel 1 (FIG. 3(*c*)). The cam lever 8 then comes into contact with the plunging part 2*d* of the calendar cam 2 and is raised thereby (FIGS. 3(*d*) and 3(*e*)). The calendar lever 16, which from the start of the movement was guided by the abutment pin 24 (FIGS. 3(*a*) to 3(*d*)), moves away therefrom (FIG. 3(*e*)). When the cam lever 8 reaches the peak 2*c* of the calendar cam 2 (FIG. 3(*e*)), the calendar lever 16 is still further away from the stars 22, 23. The cam lever 8 thus causes the calendar cam 2 to rotate rapidly in the direction S2 by its abutment on the part 2*a* of the cam 2 (FIG. 3(*f*)). This movement moves the calendar lever 16 towards the stars 22, 23 by the cooperation between the pin 19 and the U-shaped oblong opening 18. The cam lever 8 and the isolating lever 11 continue their descent along the calendar cam 2 and the isolating cam 3 respectively (FIG. 3(*g*)) until they are located in the position described in relation to FIG. 3(*a*) where the cam lever 8 is out of contact with the calendar cam 2 and the isolating lever 11 is on the lower part 3*b* of the isolating cam 3 (FIG. 3(*h*)). The beaks 20, 21 of the calendar lever 16 re-enter the respective toothings of the stars 22, 23 without driving them, i.e. they return to their position in FIG. 3(*a*) without modifying the angular position of the stars 22, 23.

Thus in each 24 hour period, from midnight to midnight, during normal operation of the timepiece or during time setting in the forwards direction, the calendar lever 16 effects an outward movement which causes its beaks 20, 21 to leave the toothings of the stars 22, 23 without touching any tooth of these toothings and, therefore, without modifying the angular position of the said stars, then a return movement which causes its beaks 20, 21 to re-enter the toothings of the stars 22, 23, causing the said stars to advance by one pitch. In each 24 hour period, from midnight to midnight, but in the reverse direction, during time setting in the backwards direction, the calendar lever 16 effects an outward movement which causes its beaks 20, 21 to leave the toothings of the stars 22, 23 without touching any tooth of these toothings and, therefore, without modifying the angular position of the said stars, then a return movement which causes its beaks 20, 21 to re-enter the toothings of the stars 22, 23 without modifying the angular position thereof and thus without causing any change to appear in the calendar display.

The user may therefore set the timepiece in the backwards direction at any time without the passage through midnight in the reverse direction causing the calendar display indicators to advance. This is made possible by the fact that, by virtue of the oblong opening 5, the two cams 2, 3 have relative angular positions which differ depending on the direction of rotation of the calendar wheel 1 (cf. FIG. 3(*c*) compared to FIG. 2(*c*)) and that consequently the movement of the calendar lever 16 differs depending on the direction of rotation of the calendar wheel 1. An important feature of the present invention is that, due to the trajectory followed by the beaks 20, 21 of the calendar lever 16, these do not have to be pivoting, they can be rigid as shown. The advantage of having rigid beaks is that they prevent the stars 22, 23 from advancing by more than one pitch under the effect of their inertia at the time of a change in date.

Figure 4:
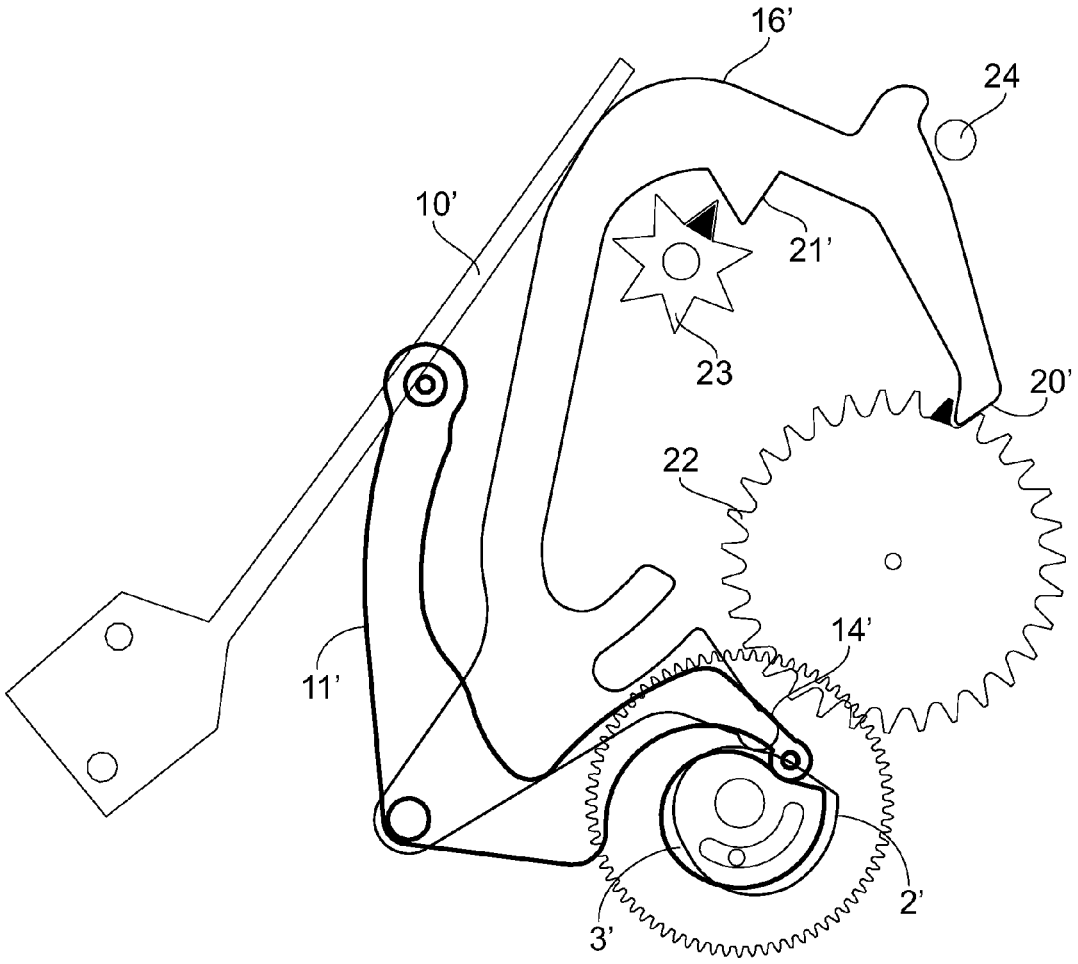
FIG. 4 shows a calendar mechanism according to a second embodiment of the invention.
Figure 5A:
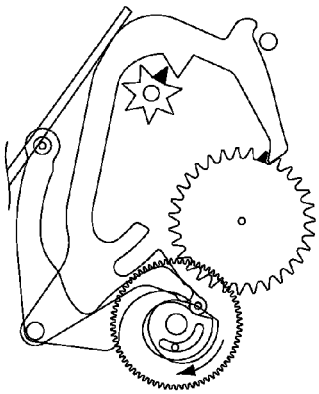
FIG. 5 shows a sequence of states of the calendar mechanism according to the second embodiment during rotation of the time indicators of the timepiece by a number of revolutions corresponding to 24 hours of time display in the clockwise direction.
Figure 5B:
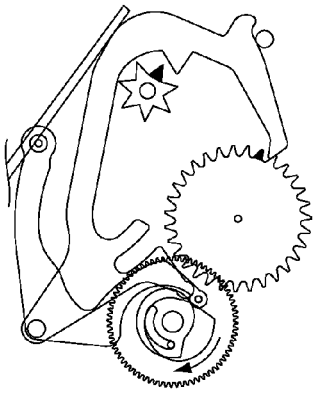
Figure 5C:
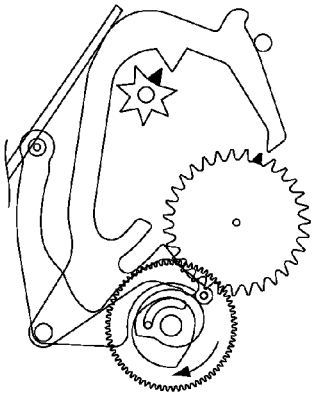
Figure 5D:
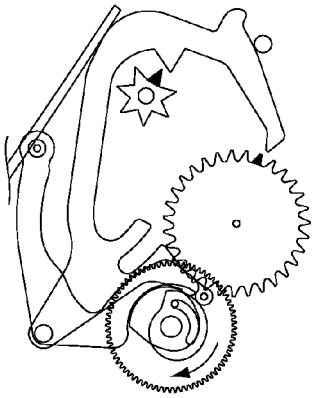
Figure 5E:
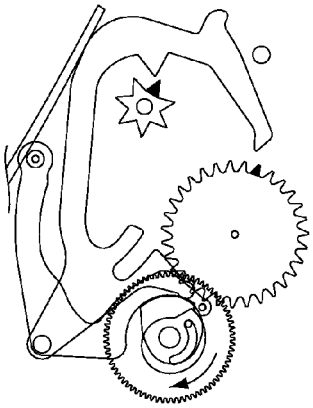
Figure 5F:
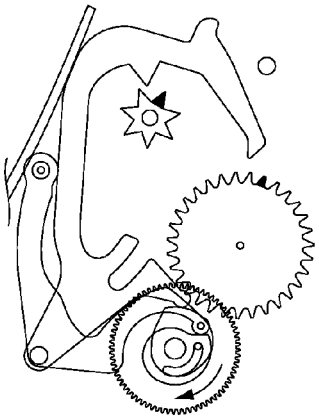
Figure 5G:
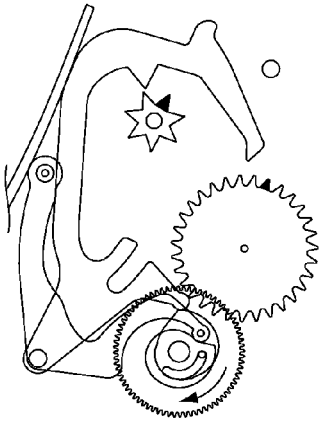
Figure 5H:
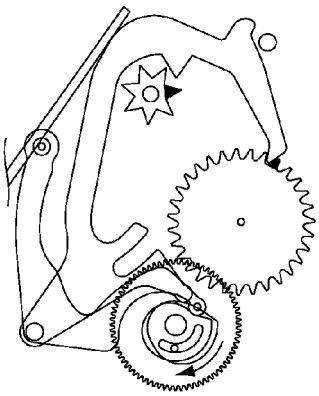
Figure 6A:
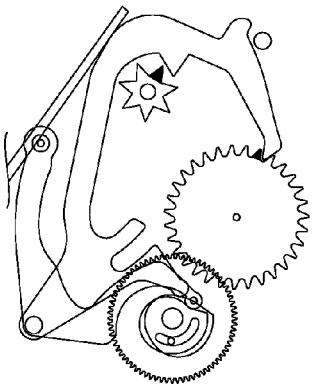
FIG. 6 shows a sequence of states of the calendar mechanism according to the second embodiment during rotation of the time indicators of the timepiece by a number of revolutions corresponding to 24 hours of time display in the anti-clockwise direction.
Figure 6B:
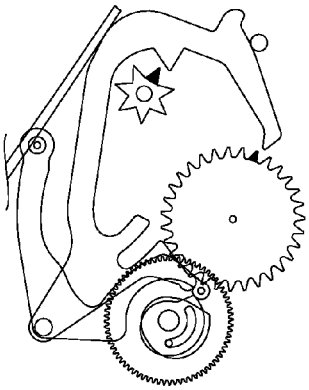
Figure 6C:
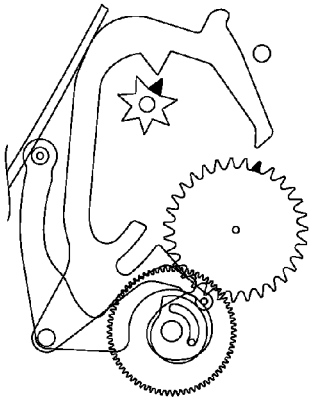
Figure 6D:
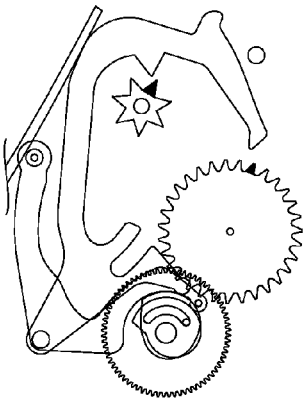
Figure 6E:
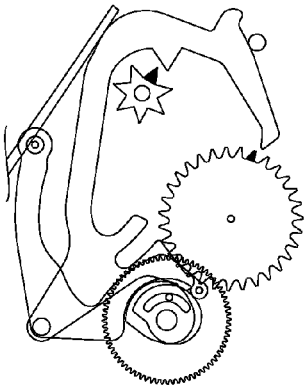
Figure 6F:
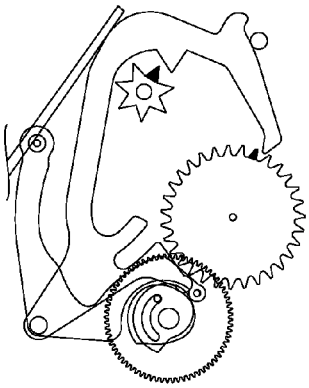
Figure 6G:
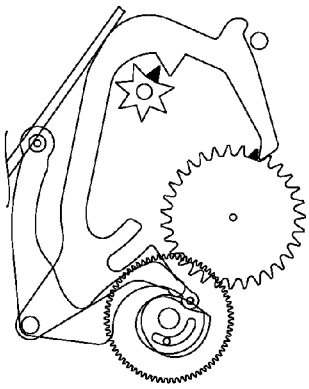

FIG. 4 shows a calendar mechanism according to a second embodiment of the invention. The calendar mechanism according to this second embodiment differs from that of the first embodiment in that the cam lever 8 is omitted and in that the calendar lever, designated by the number 16', cooperates with the calendar cam 2' instead of the cam lever 8, has for this purpose a roller 14' or a beak and is directly subject to the action of a return spring 10'. Although not shown in FIG. 4, a return spring could also act on the isolating lever 11'. The respective shapes of the calendar cam 2', of the isolating cam 3', of the calendar lever 16' and of the isolating lever 11' which carries the pivot of the calendar lever 16' and cooperates with the isolating cam 3' are slightly modified with respect to the first embodiment. The other pieces of the mechanism are unchanged.

According to the same principle as the movement described in relation to FIG. 2, in each 24 hour period, from midnight to midnight, during normal operation of the timepiece or during forwards time setting, the calendar lever 16' carried by the isolating lever 11' and guided at certain moments by the abutment pin 24 effects an outward movement which causes the beaks 20', 21' to leave the toothings of the stars 22, 23 without touching any tooth of these toothings and, therefore, without modifying the angular position of the said stars, then a return movement which causes its beaks 20', 21' to re-enter the toothings of the stars 22, 23, causing the said stars to advance by one pitch. FIGS. 5(*a*) to 5(*h*) show different successive configurations of the calendar mechanism during this movement.

According to the same principle as the movement described in relation to FIG. 3, in each 24 hour period, from midnight to midnight, but in the reverse direction, during backwards time setting, the calendar lever 16' effects an outward movement which causes the beaks 20', 21' to leave the toothings of the stars 22, 23 without touching any tooth of these toothings and, therefore, without modifying the angular position of the said stars, then a return movement which causes its beaks 20' 21' to re-enter the toothings of the stars 22, 23 without modifying the angular position thereof and thus without causing a change to appear in the calendar display. FIGS. 6(*a*) to 6(*g*) show different successive configurations of the calendar mechanism during this movement.

The calendar mechanism according to the second embodiment has the advantage of having fewer parts than that according to the first embodiment. The first embodiment, on the other hand, is advantageous in a number of respects:

- it makes it possible to control the equilibrium between the return springs of the levers more easily;
- it avoids the use of a return spring for the calendar lever, a return spring of which the abutment against the calendar lever generates friction owing to the translational component comprised by the movement of this lever;
- it permits the use of a smaller calendar cam.

With the calendar mechanism as described above, according to the first or second embodiment, a correction in the date or day independent of the time display is prevented when the beaks 20, 21 of the calendar lever 16 are engaged in the toothing of the stars 22, 23 since these beaks 20, 21 block the rotation of the stars 22, 23. In order to overcome this problem, the mechanism in accordance with the invention has a correction device illustrated in FIGS. 7 and 8.

Figure 7:
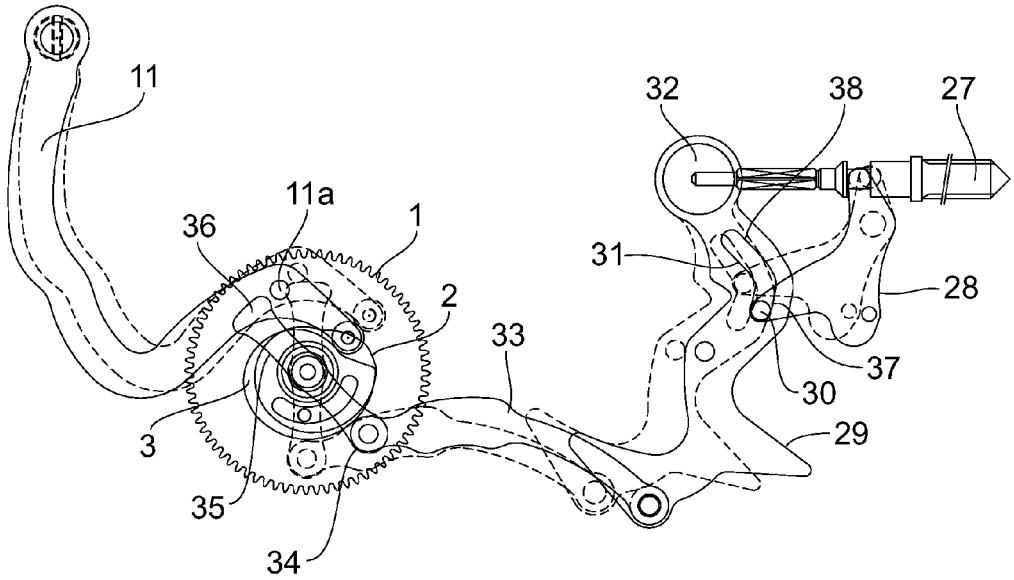
FIG. 7 shows a part of a correction device included in the calendar mechanism in accordance with the invention.

The correction device has, as shown in FIG. 7, the winding stem 27 of the timepiece which can adopt three axial positions, i.e. a winding position (pushed-in position), a position for correcting the date (intermediate position) and a time-setting position (pulled-out position). A pull-out piece 28 cooperates with the winding stem 27 to control the winding sliding pinion (not shown) in a conventional manner. In the present invention, the pull-out piece 28 also controls a lever 29 by means of a pin 30 rigidly connected to the pull-out piece 28 and engaged in an angle-bent oblong opening 31 of the lever 29. The lever 29 pivots at a point 32. A connecting rod 33 is articulated by one of its ends to the lever 29 and by its other end to a first end 34 of a second lever 35. The lever 35 pivots about the common axis of rotation of the calendar wheel 1 and of the cams 2, 3 and has a second end 36 located on the other side of the said axis with respect to the first end 34. When the winding stem 27 is in the winding or time-setting position, the levers 29, 35 and the connecting rod 33 are in their position shown in a solid line in FIG. 7, where the lever 35 does not act on the isolating lever 11 which remains in abutment against the isolating cam 3. When the winding stem 27 is in the position for correcting the date, the levers 29, 35 and the connecting rod 33 are in their position shown in a dotted line, where the isolating lever 11 is raised and distanced from the isolating cam 3 by the action of the second end 36 of the lever 35 on a pin 11*a* carried by the isolating lever 11. In this position, the beaks 20, 21 of the calendar lever 16 are outside the toothing of the stars 22, 23 and the winding stem 27 can be rotated to cause the date star 22 to rotate by means of a gear train (not shown). The fact that the levers 29, 35 and the connecting rod 33 have the same position when the winding stem 27 is in the winding or time-setting position is made possible by the angle-bent shape of the oblong opening 31. In the position for correcting the date of the winding stem 27, the pin 30 is located in the angle of the opening 31. Between the position for correcting the date and the winding position, the pin 30 cooperates with a portion 37 of the opening 31 extending from the angle to a first end of the opening. Between the position for correcting the date and the time-setting position, the pin 30 cooperates with the other portion 38 of the opening 31 extending from the angle to the second end of the opening.

Figure 8:
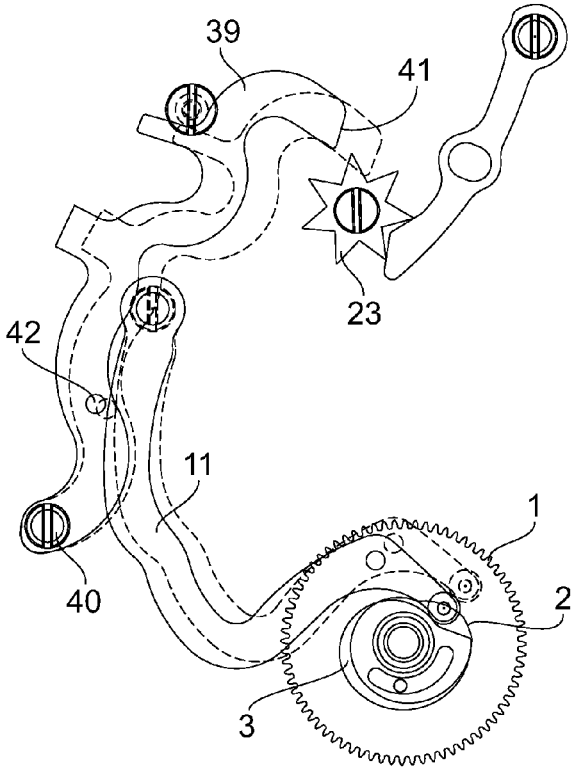
FIG. 8 shows another part of the correction device.

Another part of the correction device is shown in FIG. 8. This part is involved with the correction of the days. A day corrector 39, in the form of a lever actuated by a push button (not shown) and pivoting at a point 40, has a beak 41 which displaces by one pitch the day star 23 each time the corrector 39 is actuated. The corrector 39 is subject to the action of a return spring (not shown). The corrector carries a pin 42 which raises the isolating lever 11 upon each actuation of the corrector 39. The raising of the isolating lever 11 moves the calendar lever 16 away from the stars 22, 23 and in particular causes the beak 21 to exit the toothing of the day star 23 before the beak 41 of the corrector 39 engages in the said toothing.

Figure 9:
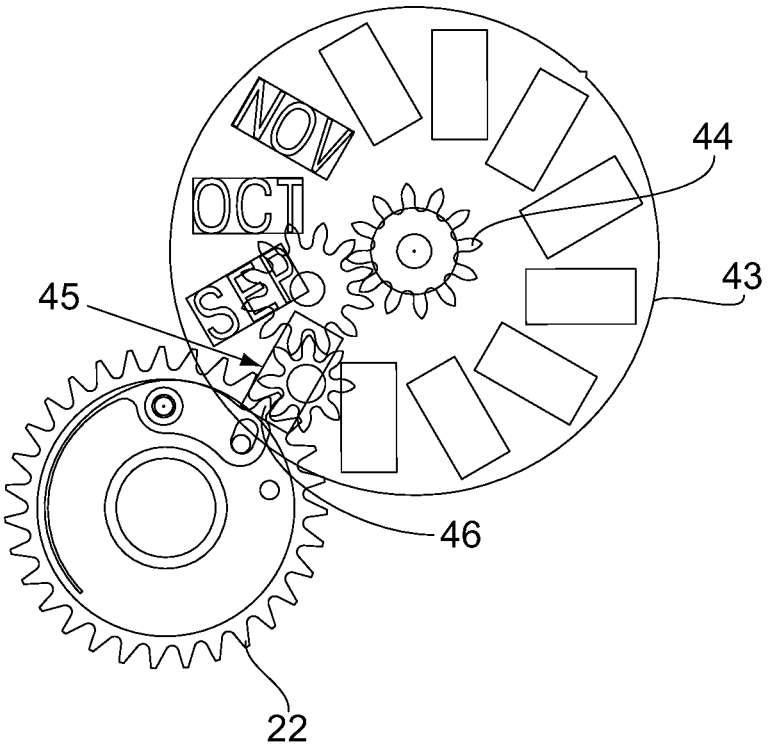
FIG. 9 shows a part for displaying the months of the calendar mechanism in accordance with the invention.

The calendar mechanism in accordance with the invention can also have a month indicator. FIG. 9 shows an example of such an indicator in the form of a disc 43 having indications for the 12 months. This indicator 43 is rigidly connected to a month pinion 44 which is driven by a gear train 45, itself driven by a retractable finger 46 carried by the date star 22. The finger 46 is placed so that the month pinion 44 is driven by one pitch upon passage of the date from the $31^{st}$ to the $1^{st}$. If a correction of the month display by a mechanism, not shown, is effected while the finger 46 is engaged in a toothing of the gear train 45, the finger 46 is retracted to prevent any blocking of the month pinion 44. The mechanism permitting the correction of the month display is e.g. a gear train connected to the winding stem by a lever so that when the winding stem is located in the axial position for correction of the date, a rotation of the stem in a determined direction corrects the angular position of the month pinion 44 while a rotation of the stem in the other direction corrects the angular position of the date star 22 by means of the said lever and of the gear train for correction of the date.

The present invention has been described above by way of example only. It is clear that modifications may be made without departing from the scope of the invention claimed. For example, if the function of not allowing the stars 22, 23 to be actuated during a backward time setting is not desired, then two cams rotationally fixed relative to each other, i.e. not having a relative rotation range, can be used. Moreover the cams could be non-coaxial.

In the following claims the term "pivot" must be understood in its broad meaning, as covering not only the physical axis on which a given lever is mounted but also, more generally, the imaginary axis about which the lever pivots. The term "mobile" covers any rotating member such as wheel, pinion, disc or star.

The invention claimed is:

1. Mechanism for driving an indicator for a timepiece, comprising:

a mobile (22; 23) for driving the indicator, a first lever (16) mounted about a first pivot (17) and comprising a beak (20; 21) intended to cooperate with a toothing of the mobile (22; 23) to move said mobile, a first cam (2) arranged to rotate the first lever (16) about the first pivot (17), a second lever (11) mounted about a second pivot (12) and to which the first pivot (17) is rigidly connected, a second cam (3) arranged to rotate the second lever (11) about the second pivot (12), and elastic means (10, 13) for maintaining the cooperation between the levers (16, 11) and the cams (2, 3), the levers (16, 11) and the cams (2, 3) being arranged so that the beak (20; 21) of the first lever (16) cyclically describes a closed curve, each cycle comprising a first motion during which the beak (20; 21) leaves the toothing of the mobile (22; 23) without changing the angular position of said mobile and a second motion during which the beak (20; 21) re-enters the toothing of the mobile (22; 23) to move said mobile.

2. Mechanism according to claim 1, wherein the beak (20, 21) is non-retractable.

3. Mechanism according to claim 2, wherein the levers (16, 11) and the cams (2, 3) are arranged so that the mobile (22; 23) moves by instantaneous jumps.

4. Mechanism according to claim 2, wherein the first and second cams (2, 3) are coaxial.

5. Mechanism according to claim 2, further comprising a third lever (8) mounted about a third pivot (9) and arranged so that the first lever (16) is driven by the first cam (2) via this third lever (8).

6. Mechanism according to claim 2, further comprising a device (28-36; 39-42) to cause the beak (20; 21) to automatically leave the toothing of the mobile (22; 23) before a correction of the position of said mobile.

7. Mechanism according to claim 1, wherein the levers (16, 11) and the cams (2, 3) are arranged so that the mobile (22; 23) moves by instantaneous jumps.

8. Mechanism according to claim 1, wherein the first and second cams (2, 3) are coaxial.

9. Mechanism according to claim 1, further comprising a third lever (8) mounted about a third pivot (9) and arranged so that the first lever (16) is driven by the first cam (2) via this third lever (8).

10. Mechanism according to claim 1, further comprising a device (28-36; 39-42) to cause the beak (20; 21) to automatically leave the toothing of the mobile (22; 23) before a correction of the position of said mobile.

11. Mechanism according to claim 10, wherein said device (28-36) can be actuated by a displacement of a winding stem (27) into a predetermined axial position.

12. Mechanism according to claim 11, wherein said device (28-36; 39-42) comprises means (35, 36; 42) for moving the second lever (11) away from the second cam (3), this motion causing a displacement of the first lever (16) causing the beak (20; 21) to leave the toothing of the mobile (22; 23).

13. Mechanism according to claim 10, wherein said device (28-36; 39-42) comprises means (35, 36; 42) for moving the second lever (11) away from the second cam (3), this motion causing a displacement of the first lever (16) causing the beak (20; 21) to leave the toothing of the mobile (22; 23).

14. Calendar mechanism for a timepiece comprising a mechanism according to claim 1.

15. Timepiece comprising a mechanism according to claim 1.

* * * * *